United States Patent [19]

Watanabe

[11] 4,452,194

[45] Jun. 5, 1984

[54] OUTBOARD MOTOR

[75] Inventor: Eifu Watanabe, Hamamatsu, Japan

[73] Assignees: Yamaha Hatsudoki Kabushiki Kaisha, Iwata; Sanshin Kogyo Kabushiki Kaisha, Hamamatsu, both of Japan

[21] Appl. No.: 414,035

[22] Filed: Sep. 2, 1982

[30] Foreign Application Priority Data

| | | | |
|---|---|---|---|
| Sep. 10, 1981 | [JP] | Japan | 56-142663 |
| Sep. 10, 1981 | [JP] | Japan | 56-142665 |
| Sep. 10, 1981 | [JP] | Japan | 56-142666 |

[51] Int. Cl.[3] ..... F02F 7/00

[52] U.S. Cl. ..... 123/195 P; 123/196 R; 123/196 W; 123/73 AD; 184/6.18

[58] Field of Search ..... 123/196 R, 195 P, 195 S, 123/73 AD, 196 W; 440/53, 88; 184/6.18

[56] References Cited

U.S. PATENT DOCUMENTS

| | | | |
|---|---|---|---|
| 2,501,470 | 3/1950 | Krueger et al. | 123/195 P |
| 2,547,128 | 4/1951 | Kiekhaefer | 123/195 R |
| 2,879,738 | 3/1959 | Culbertson | 123/195 P |
| 3,610,198 | 10/1971 | Alexandrowicz | 123/195 P |
| 3,888,227 | 6/1975 | Green et al. | 123/196 R |

*Primary Examiner*—Charles J. Myhre
*Assistant Examiner*—E. Rollins Cross
*Attorney, Agent, or Firm*—Ernest A. Beutler

[57] ABSTRACT

A water cooled, four-cycle internal combustion engine particularly adapted for use in an outboard motor. A supporting plate arrangement is used with the supporting plate extending across the driveshaft housing at its upper end. The engine is supported on the upper side of the supporting plate and an oil pan is supported on the underside of the supporting plate and depends into the driveshaft housing. The construction is such that the engine may be removed from the supporting plate without necessitating removal of the oil pan from the supporting plate so as to facilitate servicing. In addition, an oil drain is provided through the supporting plate at such a location so as to insure against leakage of the lubricant from the oil sump back into the engine regardless of whether the engine is in its normal running condition or its tilted up condition. The engine also includes an improved lubricating system for insuring good pressure lubrication of all components while minimizing the number of oil passages and avoiding the use of external oil conduits.

8 Claims, 15 Drawing Figures

22
26
22
25
21
30
84
21
88
28
27
89
23
133
85
132
131
24
129
88
86
87

OUTBOARD MOTOR

BACKGROUND OF THE INVENTION

This invention relates to an outboard motor and more particularly to an improved lubricating and mounting system for a four-cycle internal combustion engine particularly adapted for use in such a motor.

Outboard motors generally use two-cycle engines as their means for propulsion. The reason that two-cycle engines have been prominently used in connection with outboard motors is the difficulty in providing a compact and yet serviceable four-cycle engine for such an application. One of the large problems in connection with employing four-cycle engines for use in outboard motors is the difficulty in providing a crankcase or oil sump of sufficient capacity while maintaining a compact arrangement. Normally the cylinders of the engine lie on a horizontal plane and the crankshaft extends vertically. This means that the sump or oil pan must be disposed externally of the engine. The engine is normally positioned above the driveshaft housing and is contained within a cowling. If a separate oil pan is disposed beneath the cylinder block or crankcase and within the upper housing or power head above the driveshaft housing, the height of the engine becomes unduly cumbersome. In addition, the large weight of the engine and the oil pan are so elevated as to make tilting of the engine as is required in an outboard motor application difficult. In addition, this high positioning of the engine and oil pan gives rise to mounting strength problems and also makes serviceability of the engine difficult.

It is, therefore, a principal object of this invention to provide an improved lubricating system for a four-cycle internal combustion engine that lends itself to application in an outboard motor.

It is another object of this invention to provide a four-cycle lubricating system for an outboard motor wherein the oil pan and engine may be mounted independently of each other and the oil pan will not encroach into the power head casing.

When a four-cycle engine is employed as a power unit for an outboard motor, the oil pan also must be designed in such a way as to permit tilting of the engine from its normal running position to its tilted up position without having oil leakage. A particular problem in this regard may be presented if the oil is permitted to leak back into the cylinder head when the engine is tilted up.

It is, therefore, a further object of this invention to provide an improved oil pan arrangement for a four-cycle internal combustion engine in an outboard motor in which oil leakage is prevented even when the engine is tilted up.

In addition to the difficulties in positioning the oil pan for a four-cycle internal combustion engine used as an outboard motor, the system should provide good lubrication of all components. This lubrication problem is particularly acute in an outboard motor application in view of the fact that the crankshaft and camshaft both rotate about vertically disposed axes. It is desirable to maintain the oil lines for the engine to a minimum so as to reduce cost and avoid problems that may be encountered when a large number of oil lines are used. However, the lubrication system should insure adequate lubrication of all of the bearings, considering the particular difficulty that the shafts rotate about vertical axes.

It is, therefore, a still further object of this invention to provide an improved lubricating system for a four-cycle engine when the engine is operated with its crankshaft and camshaft extending vertically.

It is a further object of this invention to provide an engine lubricating system that minimizes the number of oil passages without sacrificing lubrication.

SUMMARY OF THE INVENTION

A first feature of this invention is adapted to be embodied in an outboard motor or the like that comprises a power head including an internal combustion engine, a driveshaft housing positioned beneath the power head and a supporting plate interposed between and separating the power head and the driveshaft housing. In accordance with the invention, the internal combustion engine is supported upon the upper side of the supporting plate and an oil plate for containing lubricant for the engine is supported on the lower side of the supporting plate.

Another feature of the invention is adapted to be embodied in a lubricating system for a four-cycle internal combustion engine for use with an outboard motor or the like and which is tiltable about a horizontally extending axis between a normal running position and a tilted up position. The engine has a cylinder block and cylinder head that are disposed with the cylinder bores in a generally horizontal position when the motor is in its normal running position. A support plate is positioned beneath the engine and an oil pan is supported beneath the support plate. In accordance with this feature of the invention, an oil return hole extends through the support plate for returning oil from the engine to the oil pan. The oil return hole is disposed so that it will lie beneath the cylinder head when the outboard motor is either in its normal running position or its tilted up position and forwardly of the cylinder head when the motor is in its normal running position.

A still further feature of this invention is adapted to be embodied in a lubricating system for an internal combustion engine having a crankshaft and a camshaft. The crankshaft is supported by spaced main bearing means and the camshaft is supported by spaced cam bearing means. In accordance with the invention, an oil pump discharges into a first pressure passage that extends to one of the cam bearing means and one of the main bearing means. Another oil passage intersects the first oil passage and extends to the remainder of the cam bearing means and main bearing means.

DETAILED DESCRIPTION OF THE PREFERRED EMBODIMENT

Figure 1:
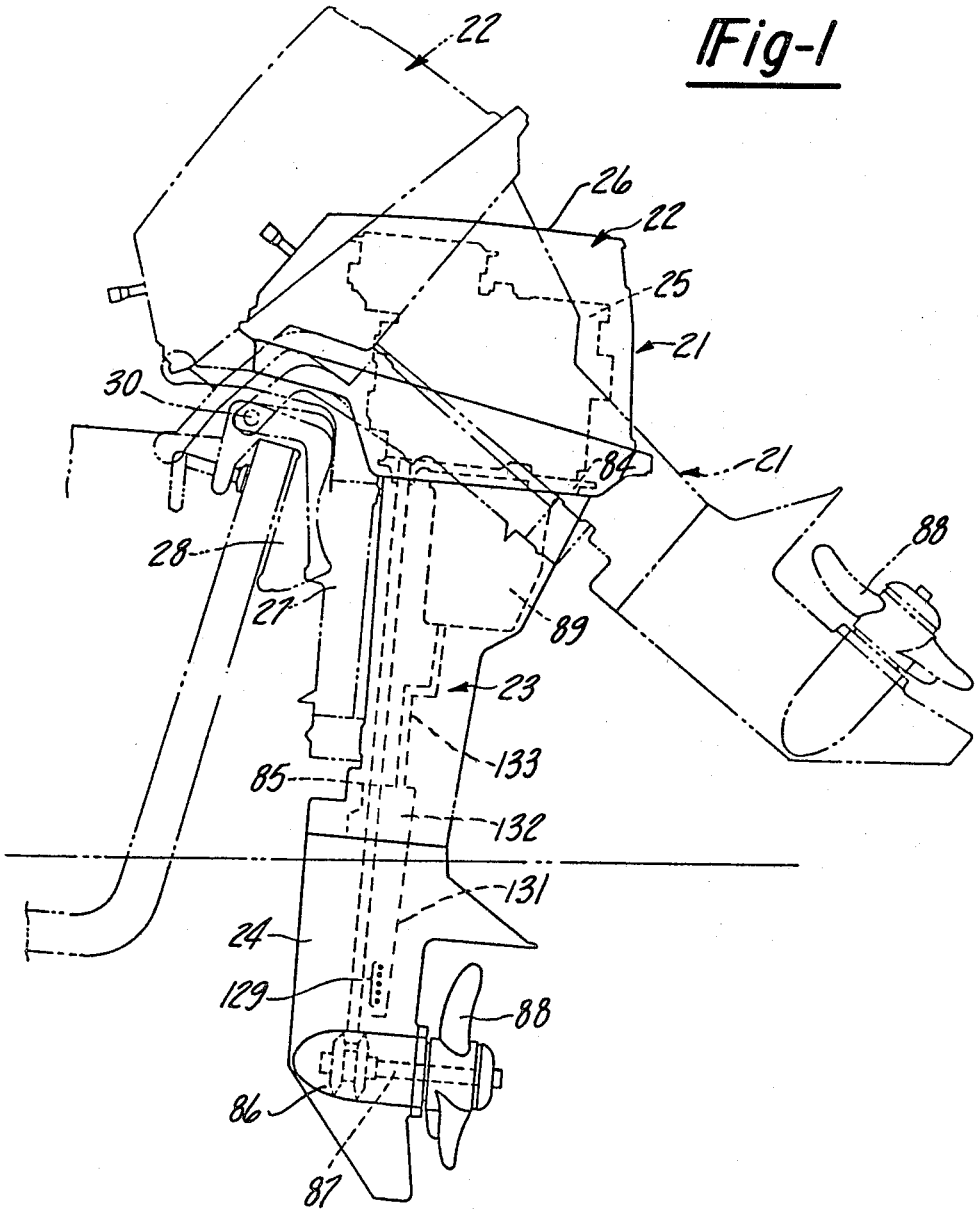
FIG. 1 is a side elevational view of an outboard motor embodying a four-cycle internal combustion engine constructed in accordance with this invention and attached to the transom of a boat. The motor is shown in its normal running condition in solid lines and in its tilted up position in phantom lines.

Referring first to FIG. 1, an outboard motor constructed in accordance with this invention is identified generally by the reference numeral 21. The motor 21 includes a power head 22, driveshaft housing 23 and lower unit 24. The power head 22 includes a four-cycle water cooled internal combustion engine, indicated generally by the reference numeral 25 and shown in more detail in the remaining figures. A protective cowling 26 of a suitable type encircles the engine 25.

The motor 21 and specifically the power head 22, driveshaft housing 23 and lower unit 24 are supported for steering movement about a generally vertically extending axis by means of a swivel bracket 27 in a known manner. The swivel bracket 27 is, in turn, pivoted to a transom clamp 28 for pivotal movement of the motor 21 about a generally horizontally extending pivot axis 30. As is well known, this arrangement permits the motor 21 to be swung from a normal operating position (as shown in the solid line views of FIG. 1) to a tilted up position as shown in the phantom line view of FIG. 1. The transom clamp 28 is adapted to be affixed in a known manner to the stern of a boat which is illustrated in phantom in FIG. 1.

Figure 2:
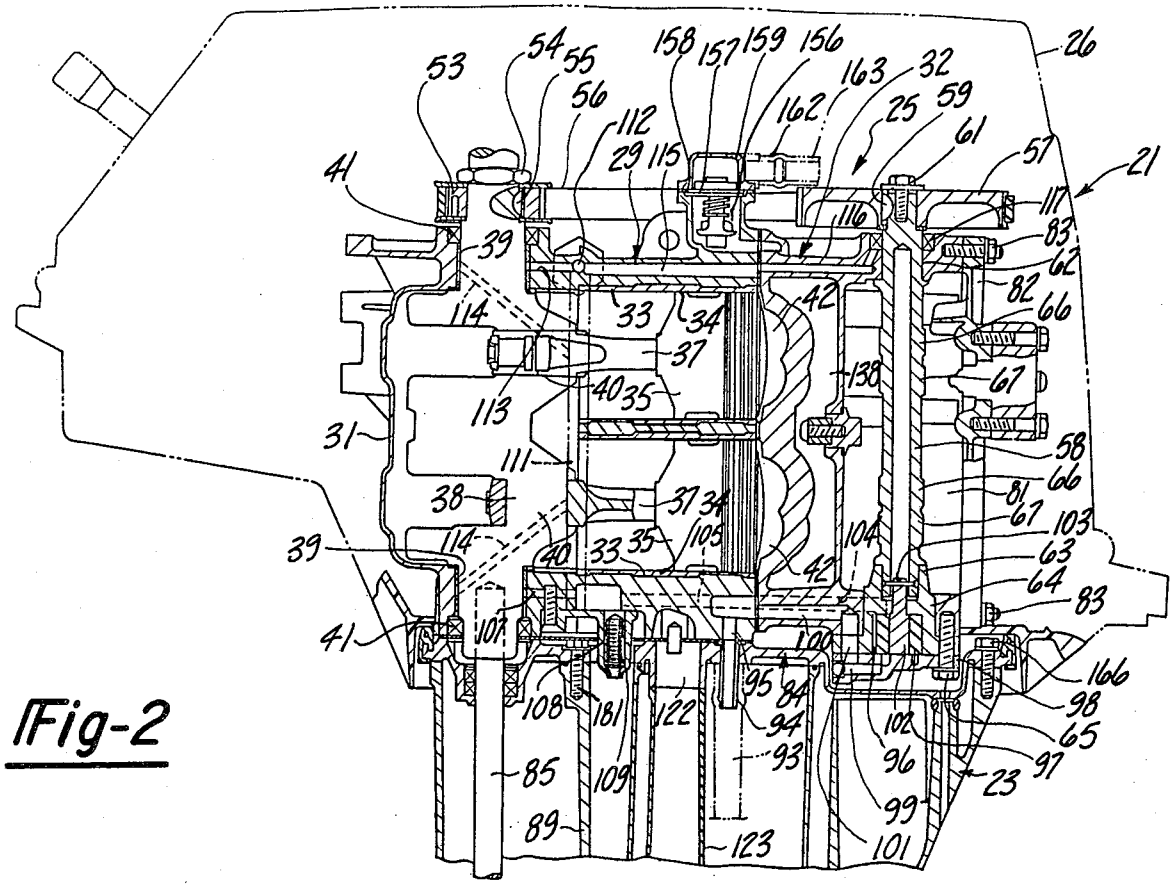
FIG. 2 is an enlarged cross-sectional view of the power head and upper portion of the driveshaft housing taken along a plane generally passing through the axis of rotation of the crankshaft.
Figure 4:
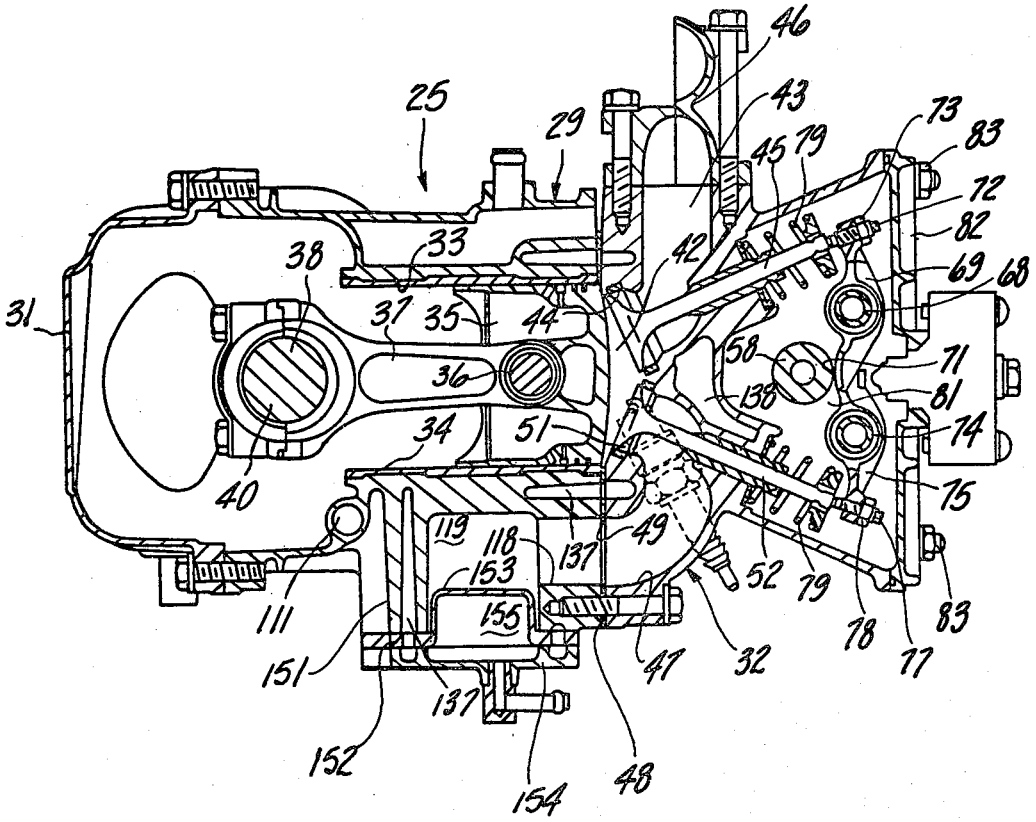
FIG. 4 is a cross-sectional view taken through a plane extending at right angles to the plane of FIG. 2 and generally along the axis of one of the cylinder bores.
Figure 5:
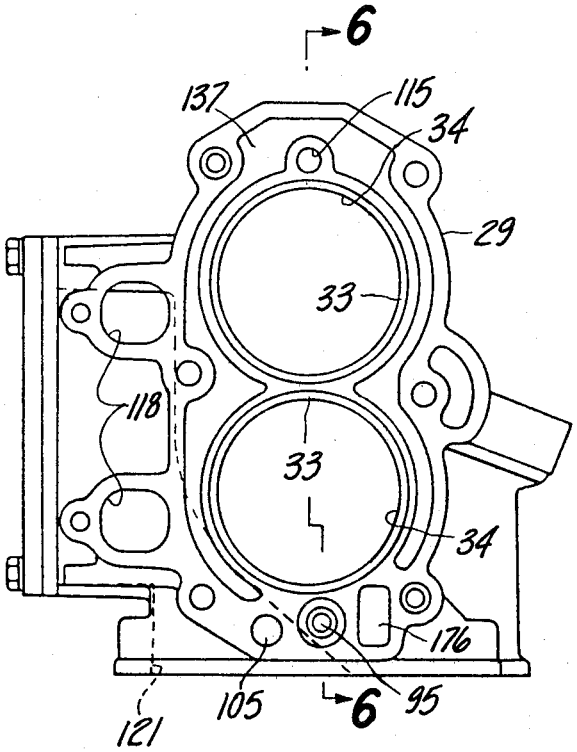
FIG. 5 is a top plan view of the cylinder block of the engine with the cylinder head removed.
Figure 8:
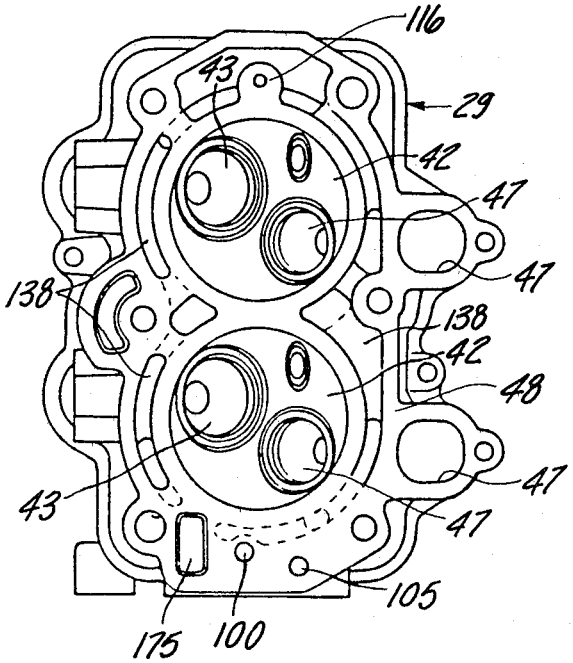
FIG. 8 is a bottom plan view of the cylinder head with the valves removed.

Referring now additionally to FIGS. 2 and 4, the engine 25 includes a cylinder block 29, a crankcase 31 and a cylinder head 32 that are affixed together in a known manner. The engine 25 is of the two-cylinder in-line type and accordingly the cylinder block 29 is formed with a pair of parallel cast-in cylinder liners 33 that define respective cylinder bores 34. Pistons 35 are supported for reciprocation in the cylinder bores 34. The pistons are connected, by means of piston pins 36 to one end of respective connecting rods 37. The connecting rods 37 are journalled at their opposite ends on rod journals 40 of a crankshaft 38 that is rotatably journalled between the cylinder block 29 and crankcase 31 by means of main bearings 39. Because the engine 25 is employed as an outboard motor, the axis of rotation of the crankshaft 38 extends vertically. A pair of seals 41 encircle opposite ends of the crankshaft 38 on the outboard side of the main bearings 39.

The cylinder head 32 is formed with a pair of cavities 42 each of which cooperate with the pistons 35 and cylinder bores 34 to form the combustion chambers. Intake passages 43 extend through the side of the cylinder head 32 and terminate at the respective cavities 42. A valve seat 44 is pressed into the cylinder head 32 at the termination of each intake passage 43 and an intake valve 45 cooperates with the seat 44 to control the flow of intake charge to the chambers 42. A suitable carburetor (not shown) is provided for delivering a fuel/air charge from a manifold, shown partly and identified by the reference numeral 46, to the intake passages 43.

Exhaust passages 47 extend through the opposite side of the cylinder head 32 from the cavity 42. Unlike conventional engines, the exhaust passages 47 are generally U-shaped and terminate at their outer end in a sealing surface 48 of the cylinder head 32 that is adapted to engage the head gasket 49 for a reason to be described. Valve seats 51 are formed at the inlet ends of the exhaust passages 47 and exhaust valves 52 control the flow through the exhaust passages 47.

A pulley or sprocket 53 is affixed to the upper end of the crankshaft 38 in a known manner by means including a nut 54 and key and keyway 55. The pulley or sprocket 53 drives a belt or chain 56 which, in turn, drives a pulley or sprocket 57 that is affixed to the upper end of a camshaft 58 by means including a key and keyway 59 and bolt and washer 61.

The camshaft 58 has an upper bearing portion 62 that is journalled in a bore formed at the upper portion of the cylinder head 32. The lower end of the camshaft 58 is formed with a cylindrical portion 63 that is journalled in a bore of a oil pump housing 64 which is, in turn, affixed to the lower side of the cylinder head 32 by means including bolts 65. As is well known in this art, the camshaft 58 rotates about an axis that is parallel to and spaced from the axis of rotation of the crankshaft 38 and is driven at one-half of the speed of rotation of the crankshaft.

The camshaft 58 is provided with a pair of intake lobes 66 and a pair of exhaust lobes 67, there being one of each of said lobes for each cylinder. An intake rocket arm shaft 68 is supported on one side of the cylinder head 32 and journals a pair of intake rocker arms 69 each of which has a follower portion 71 that is engaged with the respective intake cam lobe 66. Adjusting screws 72 are provided at the outer ends of the rocker arms 69 and cooperate with the tips of the stems of the intake valves 45 so as to operate these valves in a known manner. The adjusting screws 72 are locked in adjusted positions by jam nuts 73.

An exhaust rocker shaft 74 is supported on the side of the cylinder head 32 opposite the intake rocker shaft 68. The exhaust rocker shaft 74 journals exhaust rocker arms 75 each of which has a follower portion (not shown) that is engaged with the respective exhaust cam lobe 67. The exhaust rocker arms 75 carry adjusting screws 77 at their outer ends which engage the tips of the stems of the exhaust valves 52 for operating these valves. Jam nuts 78 hold the adjusting screws 77 in their adjusted position. The rocker arms 69 and 75 function to open the intake and exhaust valves 45 and 52. Return springs 79 encircle each of the valves for urging the valves to their closed position.

The area of the cylinder head 32 that receives the camshaft 58 defines a cam cavity 81. This cavity is closed by means of a cover plate 82 that is affixed to the cylinder head 32 by means of studs and nuts 83.

Figure 3:
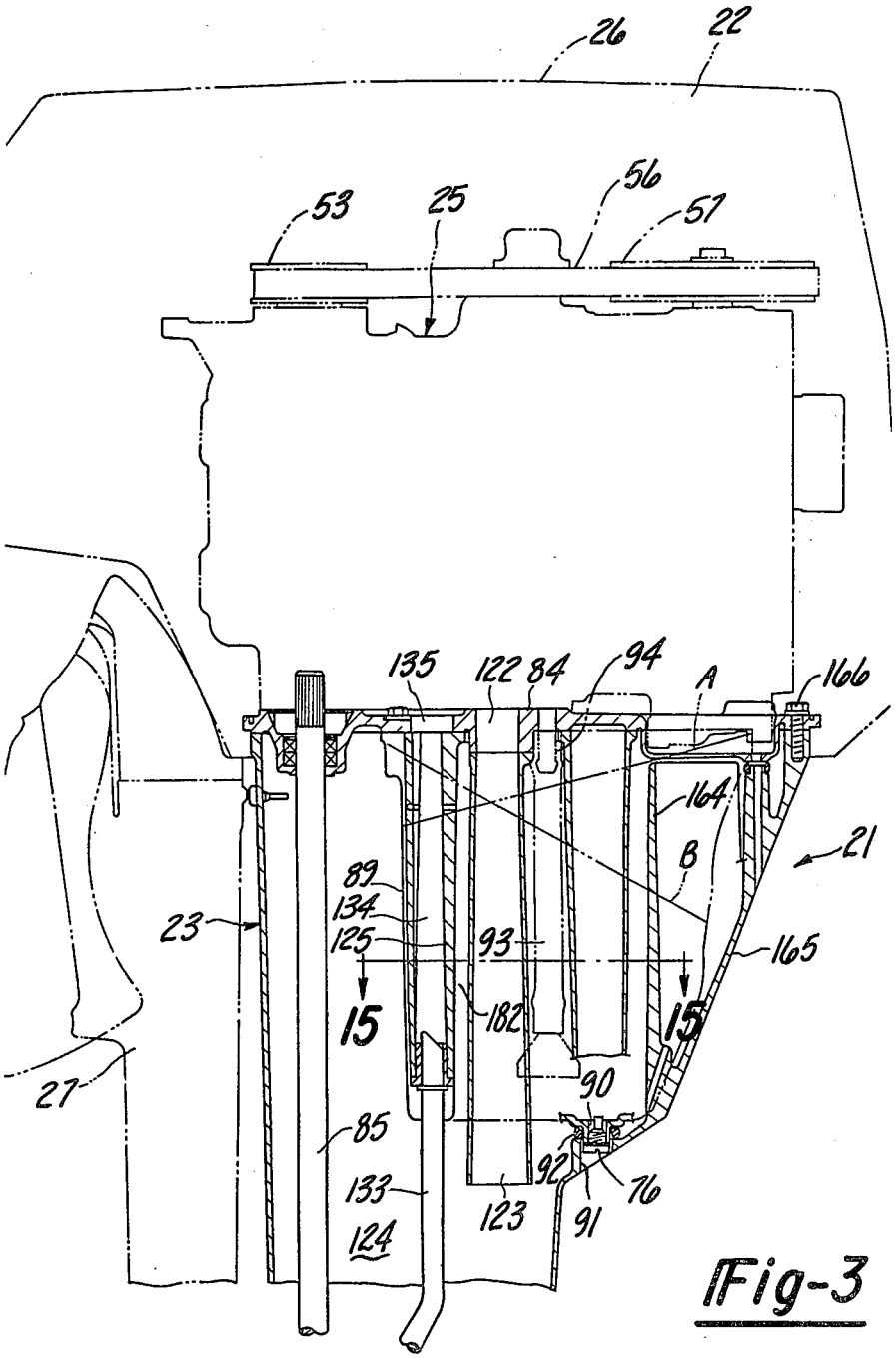
FIG. 3 is a cross-sectional view showing the oil sump of the power head and the upper portion of the driveshaft housing.

Referring now primarily to FIGS. 1 through 3, the engine 25 is supported in a manner to be described upon a combined exhaust guide and support plate 84 that extends across the upper portion of the driveshaft housing 23. The support plate 84 is, in turn, affixed to the driveshaft housing in a suitable manner which also will be described. A driveshaft 85 is affixed at its upper end for rotation with the crankshaft 38 and extends downwardly through the driveshaft housing 23 and into the lower unit 24. At its lower end, the driveshaft 85 drives a forward/reverse/neutral transmission, shown in phantom in FIG. 1 and identified by the reference numeral 86, in a known manner. A propeller shaft 87 is affixed to the output shaft of the transmission 86 and drives a propeller 88 in a known manner.

Figure 15:
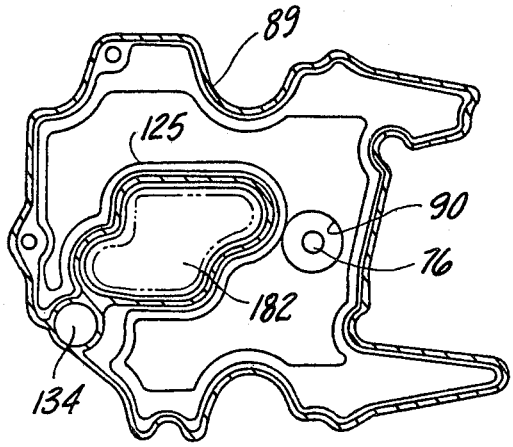
FIG. 15 is a cross-sectional view of the oil pan taken along the line 15—15 of FIG. 3.

The engine 25 is provided with a lubricating system that includes an oil pan 89 that is affixed to and depends from the underside of the support plate 84 in a manner to be described. The cross-sectional configuration of the oil pan along the plane 15—15 of FIG. 3 is shown in FIG. 15. A drain plug 76 is provided in an opening 90 in the lower wall of the oil pan 89 and is accessible through an opening 91 in the driveshaft housing 23 so as to permit draining of the oil from the oil pan 89. An O-ring seal 92 surrounds a projection of the oil pan in which the opening 90 is formed and provides a seal between the oil pan 89 and the driveshaft housing 23 in the area of the driveshaft housing opening 91.

An oil delivery tube 93 depends into the oil pan 89 from an oil inlet nipple 94 that is pressed into the cylinder block 29 and which extends through a suitable aperture in the support plate 84. The nipple 94 delivers oil to an oil pump inlet passage 95 that is formed in the cylinder block 29.

The oil pump of the engine may be best seen in FIG. 2. As has been noted, the lower camshaft end 63 is rotatably journalled in an oil pump housing 64 which is, in turn, affixed to the cylinder head 32. The oil pump housing 64 defines a pumping cavity 96 in which a pumping element 97 is positioned. The lower end of the pumping cavity 96 is closed by an oil pump cover plate 98 which is held to the oil pump housing 64 by the bolts 65 which also affix the oil pump housing 64 to the cylinder head 32. The oil pump end plate 95 has an oil delivery passage 99 that mates with an oil delivery passage 101 in the pump housing 64. The delivery passage 101 mates with a cylinder head inlet passage 100 which is, in turn, fed by the cylinder block oil inlet 95 so that oil will be delivered from the sump 89 into the pumping cavity 96.

The pumping element 97 is driven by a pump drive shaft 102 that is keyed, as by a pin 103, to the camshaft end 63. Hence, upon rotation of the camshaft 58, oil will be drawn from the sump 89 through the various passageways and pressurized by the pumping element 97.

In accordance with a feature of the invention, the oil delivery system of the engine 25 is designed in such a way as to insure adequate lubrication of all of the components while at the same time minimizing the number of oil passages which must be formed. In addition, the oil delivery system is such that no external oil piping is required to lubricate the components of the engine. The oil delivery system may be understood best by reference to FIGS. 2, 6, 7 and 9, although certain of the oil conduits appear in other of the figures.

The oil pump discharges through a main cylinder head oil pressure discharge line 104 that extends in part to lubricate the lower camshaft bearing 63 through the pump housing 64. The cylinder head pressure delivery passage 104 intersects a cylinder block main oil delivery passage 105 which, in turn, extends into a cavity 106 formed in the lower side of the cylinder block 29. The delivery line 107 extends from the cavity 106 to the lower main bearing 39 so as to lubricate this bearing. The cavity 106 is closed by a cover plate 108 that includes, among other things, an oil pressure relief valve 109 that is adapted to limit the maximum pressure in the lubrication system and which discharges back to the sump 89 in the event excess pressure causes it to open.

A transverse oil passage 111 extends through the cylinder block 29 from the cavity 106 from adjacent the lower cylinder bore 34 to a point adjacent the upper cylinder bore 34. At the upper side of the cylinder block 29, the passage 111 is intersected by a cross drilled passage 112, the outer end of which is closed in any suitable manner. The passage 112 is intersected by a further cross drilled passage 113 of a relatively smaller diameter which extends to and lubricates the upper main bearing 39. The crankshaft 38 is provided with cross drillings 114 that extend from the main bearings 39 to the rod journals 40 for lubricating these rod journals.

Intersecting the cross drilling 112 and extending away from the cross drilling 113 toward the cylinder head 32 is a larger cross drilled passage 115. The passage 115 extends at its upper end to meet an oil delivery passage 116 formed in the cylinder head 32. The cylinder head oil passage 116 terminates at a seal 117 that surrounds the upper end of the camshaft bearing portion 62. Hence, oil under pressure is delivered to the outer periphery of the camshaft 58 so that it may flow by gravity down the camshaft 58 to lubricate its various bearing surfaces.

The exhaust system of the engine will now be described primarily in relation to FIGS. 2, 3, 4, 5, 8 and 9 through 11. It has been noted that the cylinder head exhaust gas ports 47 have a generally U shape. As a result of this, the exhaust gas ports 47 of the cylinder head terminate in its lower sealing surface 48 as is clearly shown in FIG. 8 which is a view of the underside of the cylinder head 32. The cylinder block 29 has in its mating sealing surface (FIG. 5) a pair of exhaust gas collector passages 118. The exhaust gases are therefore delivered from the cylinder head exhaust gas ports 47 to the cylinder block exhaust gas collector passages 118. The passages 118 of the cylinder block merge into an enlarged collecting chamber 119 that has a passage discharge 121 that extends downwardly through the cylinder block 29 and which registers with an exhaust gas passage 122 of the support plate 84. An exhaust pipe 123 extends downwardly through a complementary opening formed in the oil pan 89 for discharge of the exhaust gases into an expansion chamber 124 of the drive shaft housing 23. This clearance in the oil pan 89 is provided by an upstanding wall 125 which surrounds the exhaust pipe 123 as may be best seen in FIG. 15.

From the expansion chamber 124, the exhaust gases are discharged in any suitable manner. For example, they may be discharged through the hollow hub of the propeller 88 with the hub type exhaust discharge. Alternatively, other exhaust arrangements may be employed.

Figure 9:
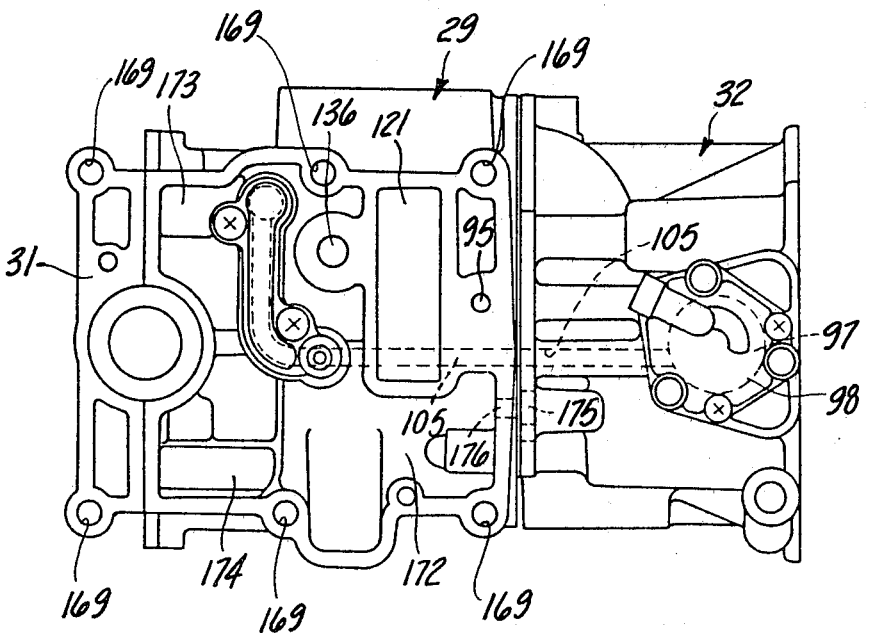
FIG. 9 is a bottom plan view of the assembled engine.
Figure 10:
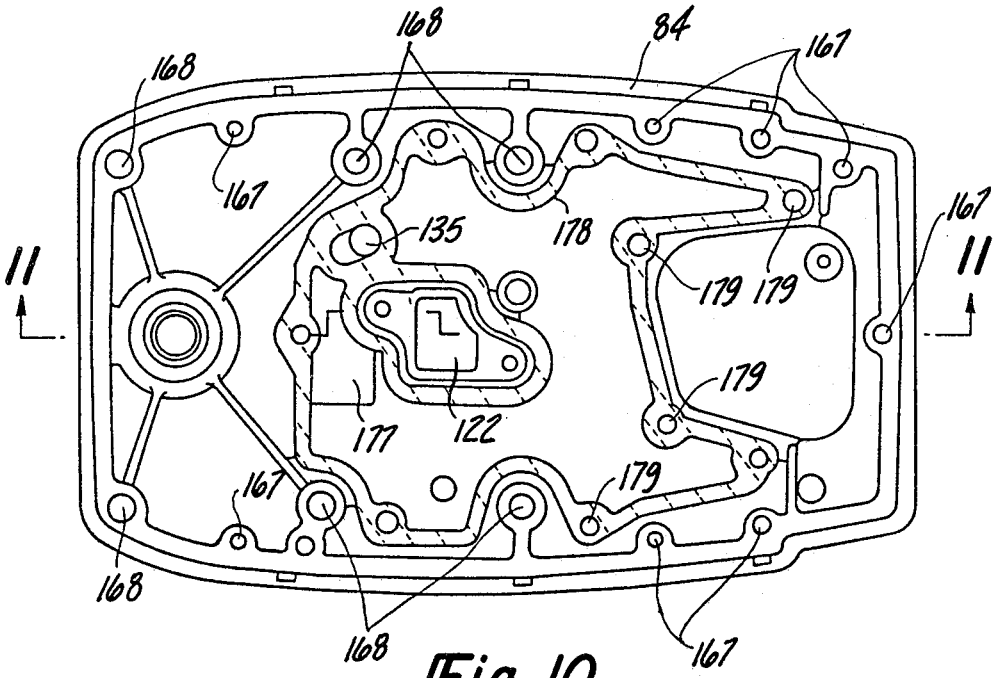
FIG. 10 is a bottom view of the spacer plate with portions shown in section.
Figure 11:
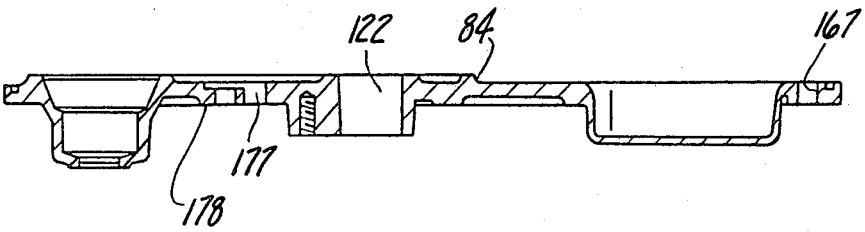
FIG. 11 is a cross-sectional view taken along the line 11—11 of FIG. 10.
Figure 12:
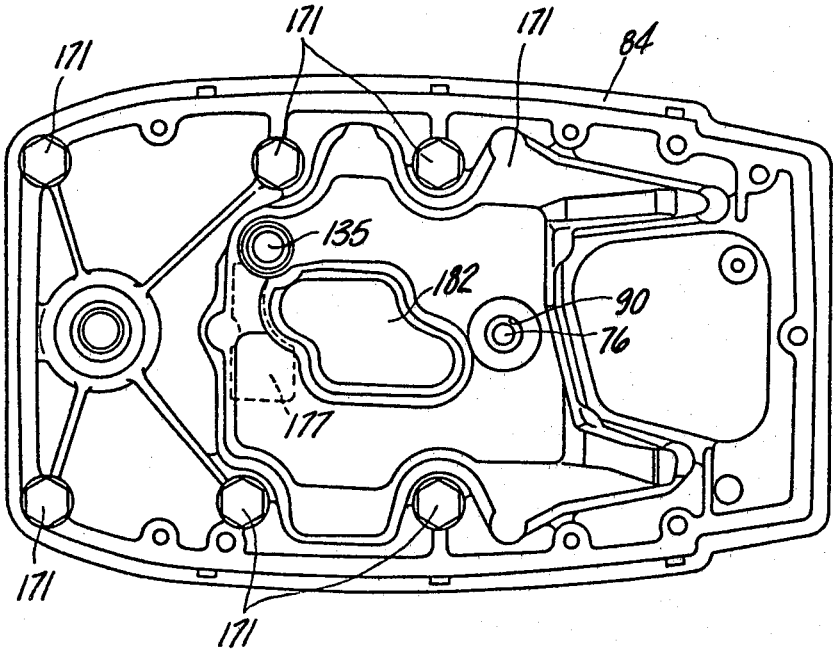
FIG. 12 is bottom plan view of the spacer plate with the engine and oil pan attached but with the spacer plate removed from the driveshaft housing.

The cooling system for the engine 25 will now be described by principal reference to all FIGS. 1 through 4. Referring first to FIG. 1, the opposite sides of the lower unit 24 are provided with a plurality of vertically spaced water inlets 129 that permit water to be drawn from the body in which the motor 21 is operating. These water inlets 129 supply a delivery pipe 131 from which, in turn, water is drawn by a coolant pump assembly 132 that is driven from the drive shaft 85 at an intermediate location and particularly at the area where the drive shaft housing 23 joins the lower unit 24. The coolant pump 132 discharges through a coolant delivery passage 133 which in turn discharges into a generally vertically extending coolant chamber 134 formed in the oil sump 89 in proximity to the lubricant therein. The coolant flows upwardly from the area 134 through a water delivery opening 135 formed in the support plate 84 (FIG. 3) for delivery to a cylinder block coolant inlet 136 (FIG. 9).

The cylinder block coolant inlet 136 serves the cylinder block cooling jacket which is of a suitable configuration and which has been identified by the reference numeral 137. The cylinder block cooling jacket 137 surrounds the cylinders 33 and serves to cool them in a known manner. In addition, coolant is delivered from the cylinder block cooling jacket 137 to a cylinder head cooling jacket, which has been indicated by the reference numeral 138. The cylinder head cooling jacket 138 encircles primarily the cavities 42 for cooling the combustion chambers.

The exhaust gases are cooled before they are delivered into the drive shaft housing 23 and lower unit 24. The structure that achieves this result may best be understood by reference to FIG. 4. The cylinder block exhaust collector portion 119 opens through an outer wall of a projection 151 formed at the outer side of the cylinder block 29. A jacket plate 152 having a cup shaped portion 153 is affixed to the outer side of the projection 151 and encloses the opening in the side of the collector portion 119. A cover plate 154 extends on the outer side of the jacket plate 153 and thus forms a coolant jacket 155 that extends a substantial distance along the collector portion 119. The jacket 155 is in fluid communication with the cylinder block cooling jacket 137 in a suitable manner. Thus, coolant that is circulates through the jacket 155 will serve to cool the exhaust gases discharged from the respective cylinders 34 before their admission to the support plate 84 and exhaust pipe 123. This cooling will prevent overheating of the drive shaft housing 23 and lower unit 24.

Coolant is delivered from the cylinder block cooling jacket 137 and cylinder head cooling jacket 138 to a well 156 (FIG. 2) formed in a projecting portion of the upper surface of the cylinder block 29 in the area between the driving and slack sides of the belt or transmitter 56. A thermostat 157 is positioned within the well 156 with its outer flange 158 clamped between the upper surface of the cylinder block projection and a thermostat housing 159 that is fixed in a suitable manner to the cylinder block between the driving and slack sides of the belt 56. The thermostat 157 will open and close to maintain a uniform temperature in the cooling jackets 138 and 139 and water will be discharged when the thermostat 157 is opened to a chamber formed in the thermostat housing 159 above the thermostat 157. This cooling water is discharged through a nipple 162 to a coolant return conduit shown in phantom and identified by the reference numeral 163.

The conduit 163 delivers the coolant to a well formed in the upper part of the driveshaft housing 23 by a vertically extending wall 164 and the rear surface 165 of the upper portion of the drive shaft housing 23 (FIG. 3). Coolant is discharged from this well outwardly of the engine in a suitable manner.

The mounting arrangement for the engine 25 on the spacer plate 84 and oil draining system from the engine 25 will now be described by principal reference to FIGS. 2, 3 and 9 through 13. The support plate 84, as has been noted, spans the upper portion of the drive shaft housing 23. The plate 94 is affixed to the upper side of the driveshaft housing 23 by means of a plurality of bolts 166. The bolts 166 pass through suitable apertures 167 formed in the plate 84. The plate 84 is also formed with a series of through holes 168 that are adapted to register with tapped holes 169 formed in the underside of both the cylinder block 29 and crankcase 31. Bolts 171 pass upwardly from the underside of the support plate 84 through the holes 168 and are received in the tapped openings 169 so as to fix the engine 25 removably to the upper side of the support plate 84.

A recess 172 is formed in the underside of the cylinder block 29 (FIG. 9). Recess 172 is in communication with a pair of lubricant discharge ports 173 and 174 that are formed in the underside of the crankcase 31 so that oil may drain from the crankcase through the passages 173 and 174 into the recess 172 for discharge through the support plate 84 into the oil sump 89 in a manner to be described. The lower side of the cylinder head and specifically the area adjacent the camshaft cavity 81 also drains into the cylinder block recess 172 via a pair of oil return passages 175 and 176 formed in the cylinder head 32 and cylinder block 29, respectively.

As has been noted, the sump or oil pan 89 is positioned below the support plate 84. It is, therefore, essential to provide an oil drain through the plate 84 so that the oil drain from the engine 25 may be returned to the sump 89. The location of this oil drain is particularly important due to the fact that the outboard motor 21 is pivoted about the tilt axis 30 from a normal position to a tilted up position. In FIG. 3 of the drawings, the oil level in the sump or oil pan 89 during the normal running condition is noted by the dot-dash line "A". The oil level when the engine 21 is tilted upwardly to its tilted up position is indicated by the broken line "B". Now if the oil drain through the support plate 84 is not properly located, oil will flow from the sump 89 back into the engine when the engine is tilted up. When the engine is next tilted down, this excess oil may flow back into the cylinder head 32, an undesirable condition.

To provide this protection, an oil drain passage 177 is provided in the supporting plate 84 in a location that will be disposed forwardly of and below the cylinder head 32 when the cylinder head 32 is either in its normal running condition or its tilted up position. As a result, oil will not tend to run back into the cylinder head 32 regardless of the fact that the engine 25 may be in its tilted up position.

Figure 7:
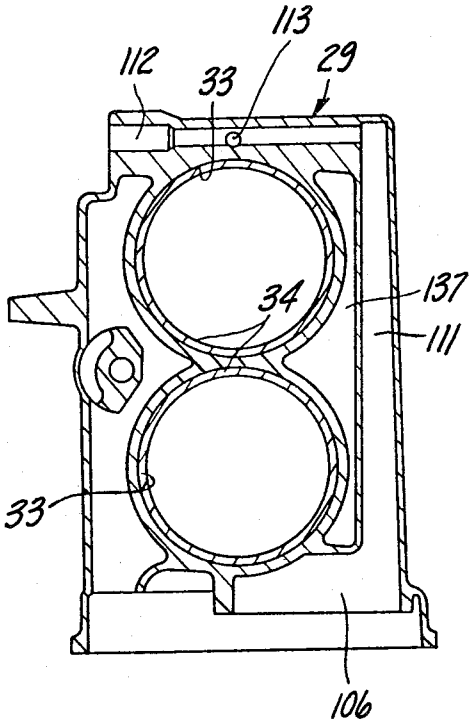
FIG. 7 is a cross-sectional view taken along the line 7—7 of FIG. 6.
Figure 6:
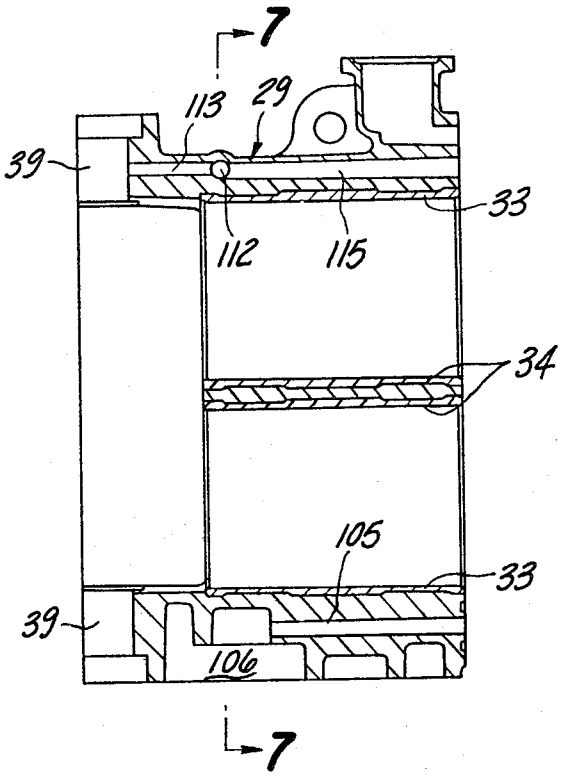
FIG. 6 is a cross-sectional view taken through along the line 6—6 of FIG. 5 with the internal components removed.
Figure 13:
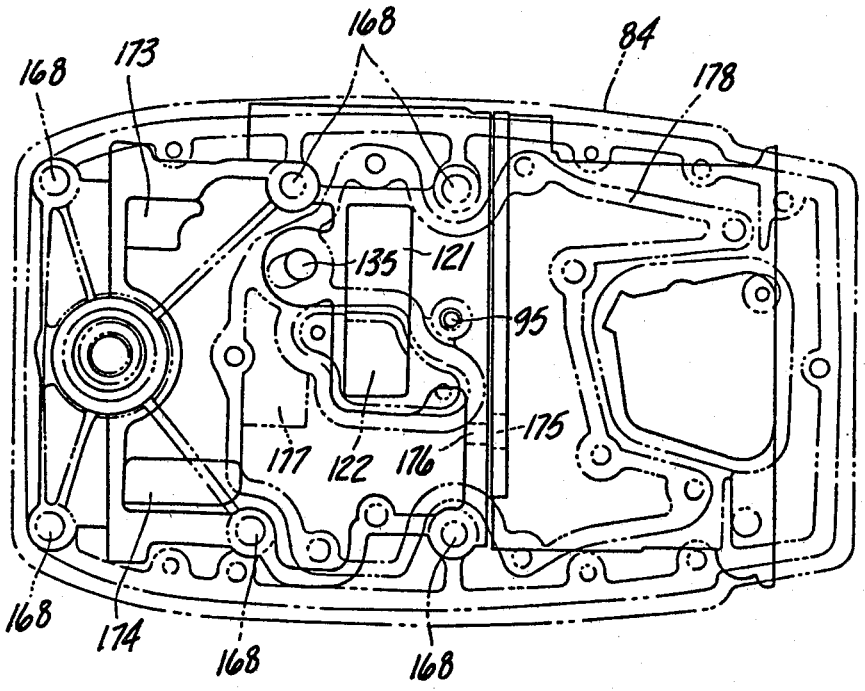
FIG. 13 is a bottom plan view of the spacer plate as mounted to the engine and removed from the driveshaft housing.
Figure 14:
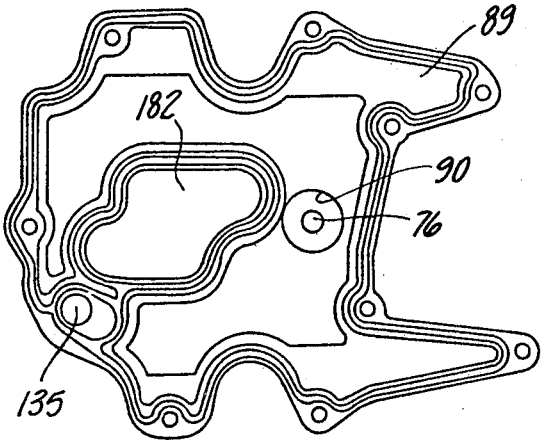
FIG. 14 is a top plan view of the oil pan.

The underside of the supporting plate 84 is provided with a mounting flange 178 that is shown in phantom in FIG. 13 and in cross-section in FIG. 7. The flange 178, as will be described, is employed for suspending the oil pan 89. It should be noted from FIGS. 10 and 13 that the flange 178 is positioned inwardly of the apertures 168 that permit attachment of the engine 25 to the upper side of the supporting plate 84. As a result of this configuration, it is possible to remove the engine 25 from the supporting plate 84 without disassembly of the sump 89 from the plate 84. This greatly facilitates servicing of the engine since all components need not be removed to service the engine.

The flange 178 is provided with a plurality of through apertures 179 that are adapted to pass bolts or the likes 181 (only one of which appears in the drawings and may be seen in FIG. 2) that are tapped into threaded openings in the upper portion of the oil pan 89 so as to affix the oil pan 89 to the underside of the supporting plate 84. As thus suspended, the oil pan 89 depends into the upper portion of the driveshaft housing 23.

As has been previously noted, the exhaust pipe 123 extends through the center of the oil pan 89. An air gap is provided between the outer periphery of the exhaust pipe 123 and an upstanding wall 125 of the oil pan 89 so as to prevent the undue transmission of heat from the exhaust system to the lubricating system. This air gap is identified by the reference numeral 182 in the drawings. It should be noted that the wall 125 that surrounds the exhaust pipe air gap 182 is also integral with the wall that defines the water chamber 134 that delivers cooling water to the engine coolant system. As a result, there will be further cooling of this area surrounding the exhaust pipe.

It should be readily apparent that the aforedescribed construction permits an extremely compact water cooled four-cycle engine wherein the oil sump of the engine depends into the driveshaft housing and thus does not unduly increase the height of the engine. Furthermore, the arrangement is such that all components may be relatively easily serviced. For example, if it is desired to inspect or service the engine, it is only necessary to remove the outer cowling 26 and remove the bolts 166 so that the entire engine 25 and suspended oil pan 89 may be removed. Servicing of the engine 25 may be accomplished without removal of the oil pan 89 since, as has been noted, the engine supporting bolts 171 are positioned outwardly of the oil pan. This also permits servicing without the likelihood of spilling of the oil. In addition to facilitating servicing, all of the heavy components of the engine are supported by the relatively robust support plate 84 and there is very little cantilevered support of any component.

Also as has been noted, the arrangement is such that tilting up of the engine from its normal running condition will not be accomplished by any spillage of oil, particularly back into the moving components of the engine such as the cylinder head.

In addition to the foregoing advantages, the engine is provided with a relatively simple and yet highly effective lubricating system wherein it is insured that a good flow of lubricant to all highly stressed components will be assured without requiring separate external passages.

Although the invention has been described in conjunction with a two-cycle in-line engine, it should be readily apparent that the invention can be used with engines of other cylinder numbers and cylinder configurations.

It should be understood that the foregoing description is that of a preferred embodiment of the invention and that various changes and modifications may be made without departing from the spirit and scope of the invention, as defined by the appended claims.

I claim:

1. An outboard motor comprising a power head including an internal combustion engine, a driveshaft housing positioned beneath said power head, a supporting plate interposed between and separating said power head and said driveshaft housing, said internal combustion engine being supported upon the upper side of said supporting plate, and an oil pan for containing lubricant for said engine supported upon the lower side of said supporting plate.

2. An outboard motor as claimed in claim 1 wherein the internal combustion engine is supported for removal from the supporting plate without removal of the oil pan therefrom.

3. An outboard motor as claimed in claim 2 wherein the lower side of the supporting plate is provided with a surface for engaging the upper surface of the oil pan, there being apertures formed in said supporting plate outwardly of said surface for passing fasteners for affixing said engine to the upper side of said supporting plate.

4. An outboard motor as claimed in claim 1 further including an exhaust pipe affixed to the supporting plate and depending therefrom, said internal combustion engine having exhaust passage means adapted to communicate with said exhaust pipe when said engine is affixed to said supporting plate, said oil pan being defined in part by a wall that surrounds and passes said exhaust pipe.

5. An outboard motor as claimed in claim 4 wherein the oil pan defines a water cooling inlet for the engine, said water cooling inlet being defined at least in part by a wall that is integral with the surrounding wall of the exhaust pipe.

6. An outboard motor as claimed in claim 1 further including an oil return drain extending through the supporting plate from a drain of the engine to the oil pan.

7. An outboard motor as claimed in claim 6 wherein the oil drain is positioned to be below and forwardly of the engine cylinder head when the outboard motor is in its normal driving position and downwardly of the cylinder head when the engine is in a tilted up position.

8. In a lubricating system for a four-cycle internal combustion engine for an outboard motor tiltable about a horizontally extending axis between a normal running position and a tilted up position having a cylinder block and a cylinder head disposed with cylinder bores in a generally horizontal position when said motor is in its normal running position, a supporting plate disposed beneath said engine, and an oil pan supported beneath said supporting plate, the improvement comprising an oil drain hole extending through said supporting plate for returning oil from said engine to said oil pan, said oil return hole being positioned to be forwardly of and beneath the cylinder head when the engine is in its normal running condition and beneath the cylinder head when the engine is in its tilted up position.

* * * * *